US006394844B1

(12) United States Patent
Frias Valero et al.

(10) Patent No.: US 6,394,844 B1
(45) Date of Patent: May 28, 2002

(54) ELECTRICAL CONNECTOR FOR HIGH SPEED SIGNAL TRANSMISSION

(75) Inventors: Eduard Frias Valero; Luis Llorente Ventura, both of Barcelona; Josep Sanabra Jansa, Vilanova i la Geltru, all of (ES)

(73) Assignee: Tyco Electronics AMP Espanola, S.A., Barcelona (ES)

( * ) Notice: Subject to any disclaimer, the term of this patent is extended or adjusted under 35 U.S.C. 154(b) by 0 days.

(21) Appl. No.: 09/790,292

(22) Filed: Feb. 22, 2001

(30) Foreign Application Priority Data

Feb. 21, 2000 (EP) ..... 00103625

(51) Int. Cl.[7] ..... H01R 13/648
(52) U.S. Cl. ..... 439/608; 439/701
(58) Field of Search ..... 439/676, 404, 439/608, 607, 535, 536, 701

(56) References Cited

U.S. PATENT DOCUMENTS 4,725,249 A * 2/1988 Blackwood et al. ..... 439/535
4,756,695 A * 7/1988 Lane et al. ..... 439/535
5,186,647 A 2/1993 Denkmann et al. ..... 439/395
5,484,308 A 1/1996 Gotz et al. ..... 439/536
6,095,852 A * 8/2000 Gregory, II ..... 439/701

FOREIGN PATENT DOCUMENTS

EP 0 274 487 B1 1/1995 ..... H01R/31/00
EP 0 525 703 B1 11/1995 ..... H01R/13/719

* cited by examiner

*Primary Examiner*—Tulsidas Patel
*Assistant Examiner*—Phuong Dinh

(57) ABSTRACT

A high frequency connector having a main housing having an open mounting side, a cable side and a partition at the cable side defining two compartments where each compartment is in communication with the mounting side and the cable side; a plurality of contacts, where a pair of contacts are positioned in the compartments such that the contacts are exposed from mating with a complementary electrical interface on the mating side and wires of a cable on the cable side; and a rear cover that is fittable to the main housing on the cable side in order to close the open cable side and cover the exposed contacts therein where the cover further includes a second partition configured to mechanically and electrically engage the partition of the main housing where the two partitions are conductive and act as a shield between the two compartments.

6 Claims, 9 Drawing Sheets

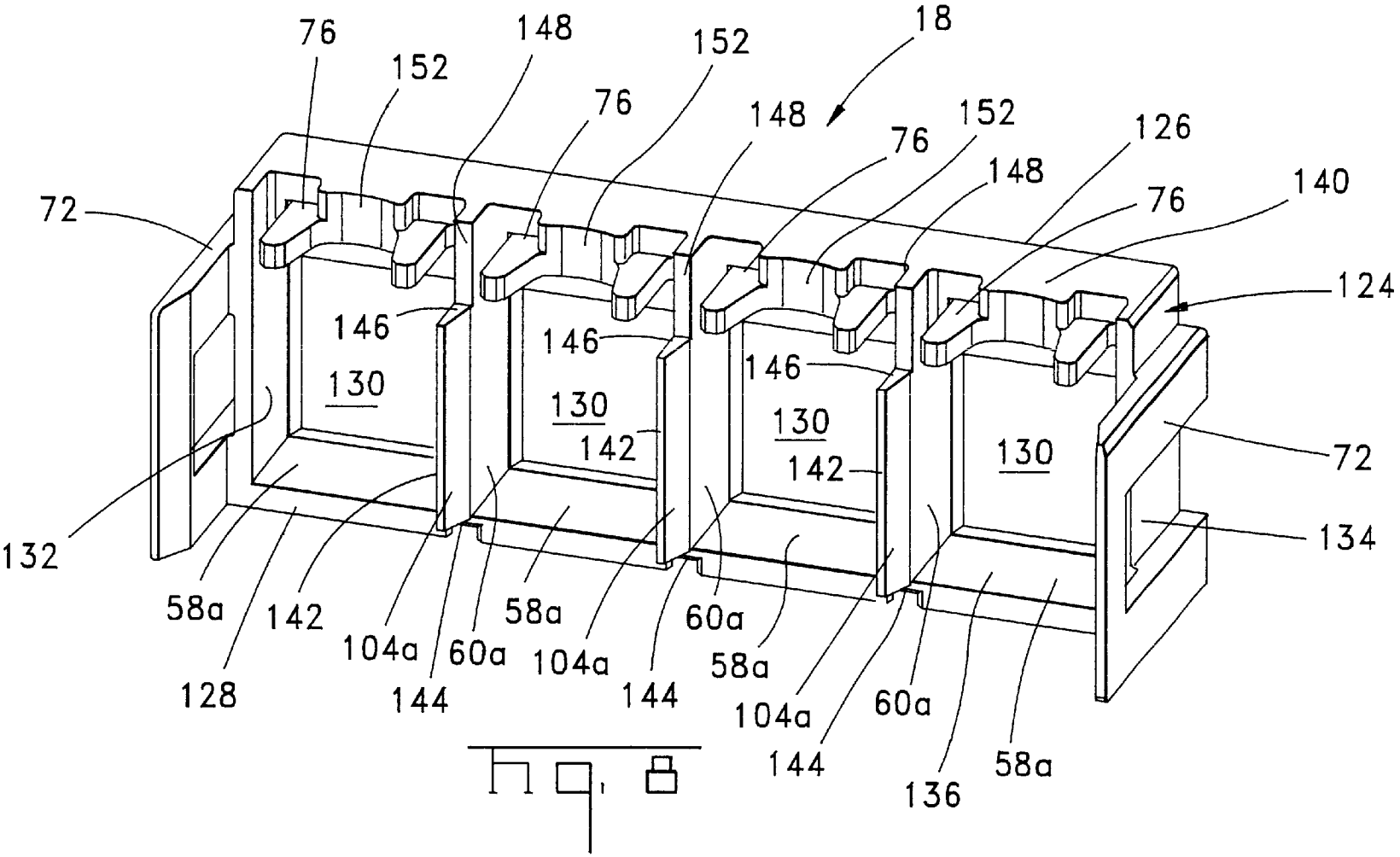
18
124
140
126
76
148
152
72
134
130
142
146
144
104a
60a
58a
136
128
132

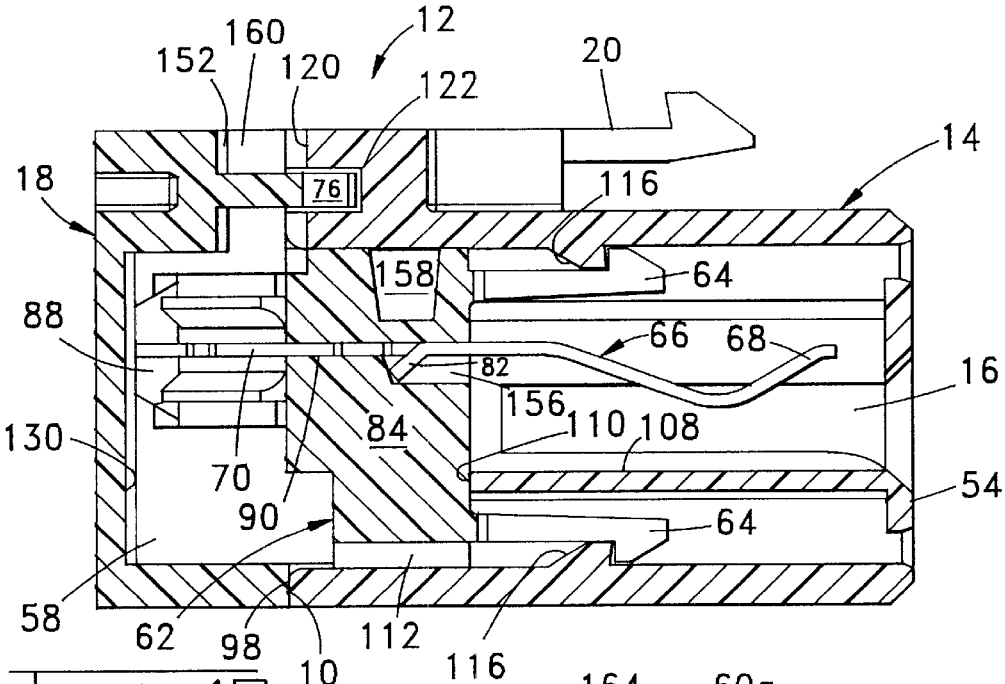
Fig. 10
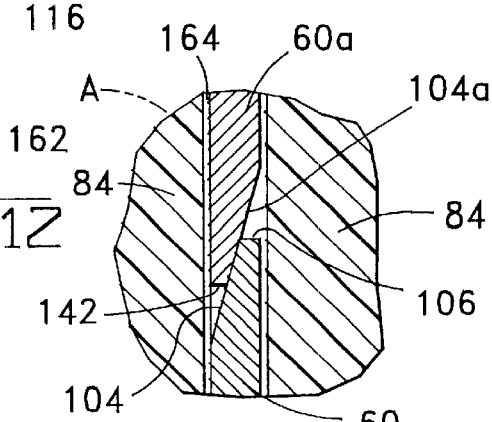
Fig. 12
Fig. 11
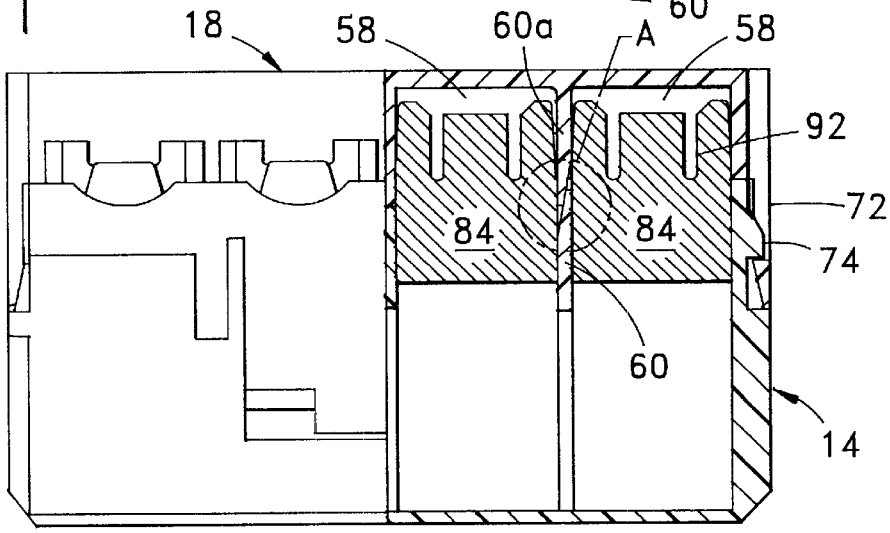

ELECTRICAL CONNECTOR FOR HIGH SPEED SIGNAL TRANSMISSION

BACKGROUND OF THE INVENTION

The present invention relates generally to electrical connectors and in particular to high transmission speed communication connectors.

DESCRIPTION OF THE PRIOR ART

It is well known to transmit data over twisted-pair cabling for communication signal transmissions. A particular application where this cabling finds wide-spread use is in building wiring. In order to provide the flexibility necessary to utilize various pieces of equipment, which may have different interface requirements, it is desirable to have a flexible interconnect to the building wiring, as opposed to attempting to hard wire the equipment into the building wiring or to provide dedicated plugs for one particular interface requirements.

One particularly advantageous flexible interconnect system is set out in EP 274 487. In this system, the building wiring is terminated in an edge-card connector. The edge-card connector is then mounted in a wall box. An interface insert that includes a common printed circuit board (PCB) with a standardized edge-card interface corresponding to the edge-card connector is provided. This insert further includes a communications connector mounted thereupon that is set in a mounting bezel so that as the insert is plugged into the edge-card, the bezel is received in the box. Depending upon the interface required, an insert with a different connector is incorporated onto the PCB and by exchanging the inserts, access to the building wiring is provided for various equipment interfaces. This provides the flexibility necessary to accommodate the many different types of equipment that are used within buildings today.

Since this particularly flexible interconnection system has been introduced, the signal transmission speeds of copper-based communication systems have risen dramatically. As the signal transmission speeds have increased, so has the susceptibility of the signals being carried by the system to degradation from such things as the electromagnetic interference from other electrical devices or cabling within the building and even adjacent signal line cross-talk.

In order to accommodate the new signal transmission speeds, improved twisted-pair cabling has been developed. This cabling is known as foil shielded twisted-pair, screened foil shielded twisted-pair and pair in metal foil twisted-pair. These various shielding or screening techniques are used in order to try to prevent any outside influences from effecting the signal being transmitted along the cable and/or a particular twisted-pair. It is not uncommon, over the life of the building, for the internal wiring to be upgraded.

In addition, improvements have been made to other parts of the system. For example, in EP 525 703 proposals to improve on an insert are set out. In addition, there has been much study relating to improving basic data connectors, such as the common modular jack receptacle. An example of this improvement is set out in U.S. Pat. No. 5,186,647. Finally, it has been known to utilize metallized plastic boxes from U.S. Pat. No. 5,484,308 or metal boxes for housing the cable termination and the edge-card connector. It is further known to electrically close the box by metallizing at least one side of the plastic adapter that fits around the connector mounted upon the PCB so that the interface with the building wiring is generally protected from the outside.

However, signal speeds have continued to increase and further improvement on the existing system has brought the requirement to provide an improved edge-card connector. This improved edge-card connector should retain the desirable flexibility of the existing system and work with the already improved components thereof. Additionally, it is desirable that the improved edge-card connector would have backward compatibility so that it could be installed within existing systems. These goals have been met by the present invention, which while particularly attractive in an edge-card form, may be useful with other interfaces and outside of building wiring systems.

SUMMARY OF THE INVENTION

The present invention addresses the aforementioned objects by providing a high frequency connector with: a main housing having an open mounting side, a cable side and a partition at the cable side defining two compartments where each compartment is in communication with the mounting side and the cable side; a plurality of contacts, where a pair of contacts are positioned in the compartments such that the contacts are exposed for mating with a complementary electrical interface on the mating side and wires of a cable on the cable side; and a rear cover that is fittable to the main housing on the cable side in order to close the open cable side and cover the exposed contacts where the cover further includes a second partition configured to mechanically and electrically engage the partition of the main housing where the two partitions are conductive and act as a shield between the two compartments.

It is advantageous that this connector can be configured as an edge-card connector.

It is further advantageous that the main housing and the cover can be conductive or metallized plastic to provide complete shielding of the interconnections within the connector and in particular individually shield the compartments.

It is yet further advantageous that the compartments can be provided with a wire exit having a metallized saddle where any foil or screening about a twisted wire pair would sit such that shielding continuity would exist between the cable and the screening at a given compartment.

It is still further advantageous that the partitions are formed with tongues having chamfered surfaces thereupon that abut with one another along the chamfers to assure shielding continuity between the compartments.

BRIEF DESCRIPTION OF THE DRAWINGS

FIG. 3 is a partially exploded perspective view of the electrical connector utilized in the system of FIG. 1 incorporating the present invention;

FIG. 8 is an interior perspective view of a cover of the connector of FIG. 3;

FIG. 9 is a further assembled view of the electrical connector of FIG. 3 shown ready for termination of the wires of a building cable;

FIG. 10 is a side sectional view of an assembled view of the connector of FIG. 3;

FIG. 11 is a upper partial section view of the assembled connector of FIG. 3; and FIG. 12 is a detailed view taken from FIG. 11 at detail A.

DETAILED DESCRIPTION OF THE PREFERRED EMBODIMENT

Figure 1:
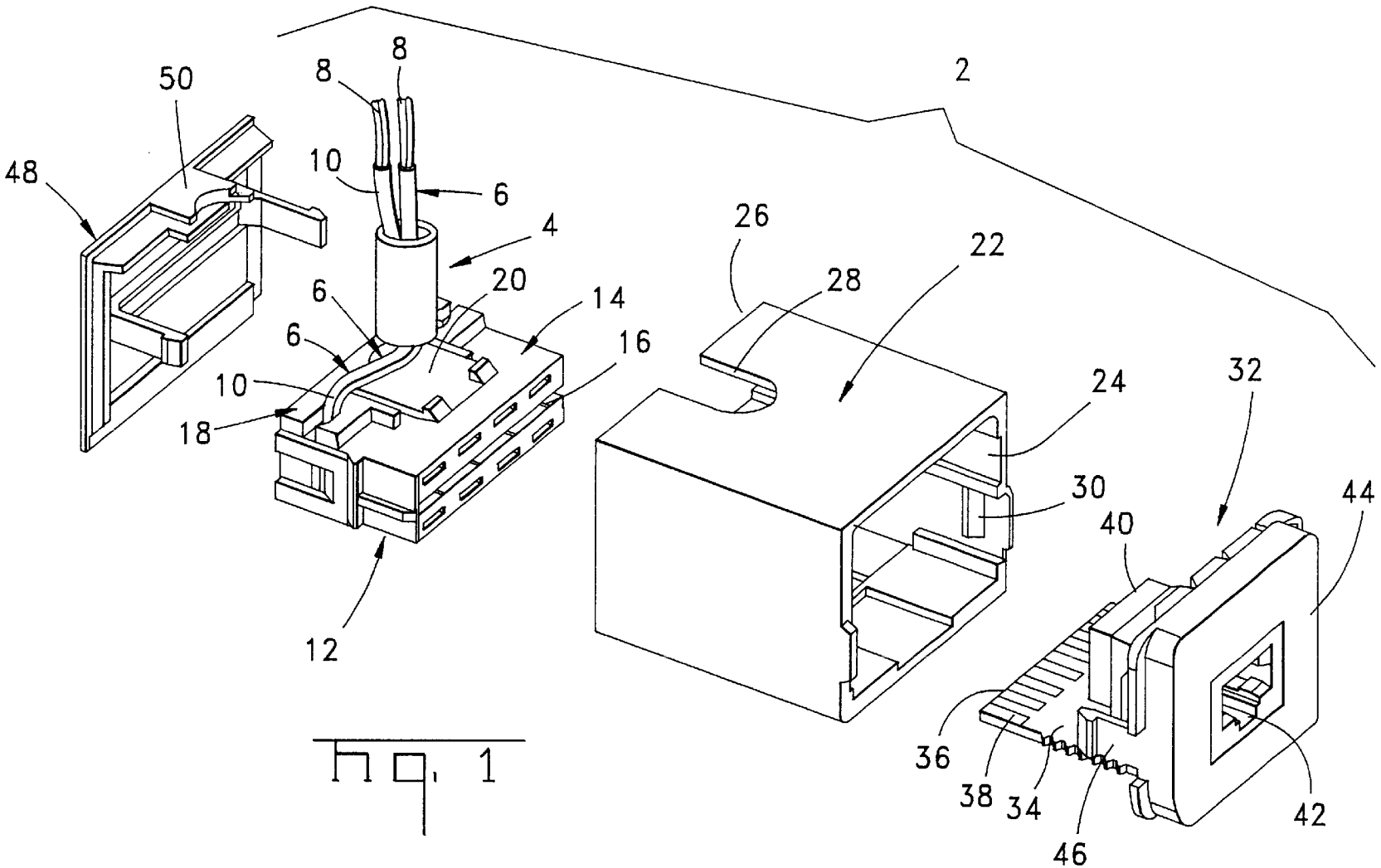
FIG. 1 is an exploded perspective view of a building interface system utilizing a connector according to present invention.

With reference first to FIG. 1, a building wiring system interface utilizing the present invention is shown generally at 2. This building wiring system consists of a cable 4 having multiple signal conductors 6 in the form of twisted wires 8 that are surrounded by individual shielding 10, which could take on the form of a foil. The conductors 6 are terminated by an electrical connector 12 incorporating the present invention. The electrical connector 12 includes a main housing 14 having an edge-card receiving slot 16 and a rear cover 18. The connector 12 further includes a latch 20 for retaining the connector 12 in an access box 22. While the connector 12 utilizes an integrally molded latch 20, for snapping the connector 12 into the box 22, other mounting techniques may be used, such as a screw or other fastener. The box 22 is a rectangular shell having a forward opening 24, a rear end 26 and a cable exit 28. The forward end includes latches 30 for retaining an insert 32 therein. The insert 32 includes a PCB 34 having a rear end 36 formed as a card edge with multiple conductors 38 thereupon. A connector 40 is incorporated onto the PCB 34. In particular, this connector 40 is a modular jack receptacle and provides an interface 42 for receiving a modular jack plug (not shown). The interface 42 is surrounded by a bezel 44 that includes latch arms 46 to engage latches 30 in box 22 when the insert 32 is placed within the box 22.

A rear cover 48 is provided to close the rear end 26 of the box 22 once the connector 12 is mounted therein. The rear cover 48 includes a tab 50 that is received within the slot 28 of box 22 when the cover 48 is affixed thereto. The tab 50, in cooperation with the edges of the slot 28, engages the cable 4 to provide strain relief and possibly grounding of any general shielding of the cable 4 to the box 22.

Figure 2:
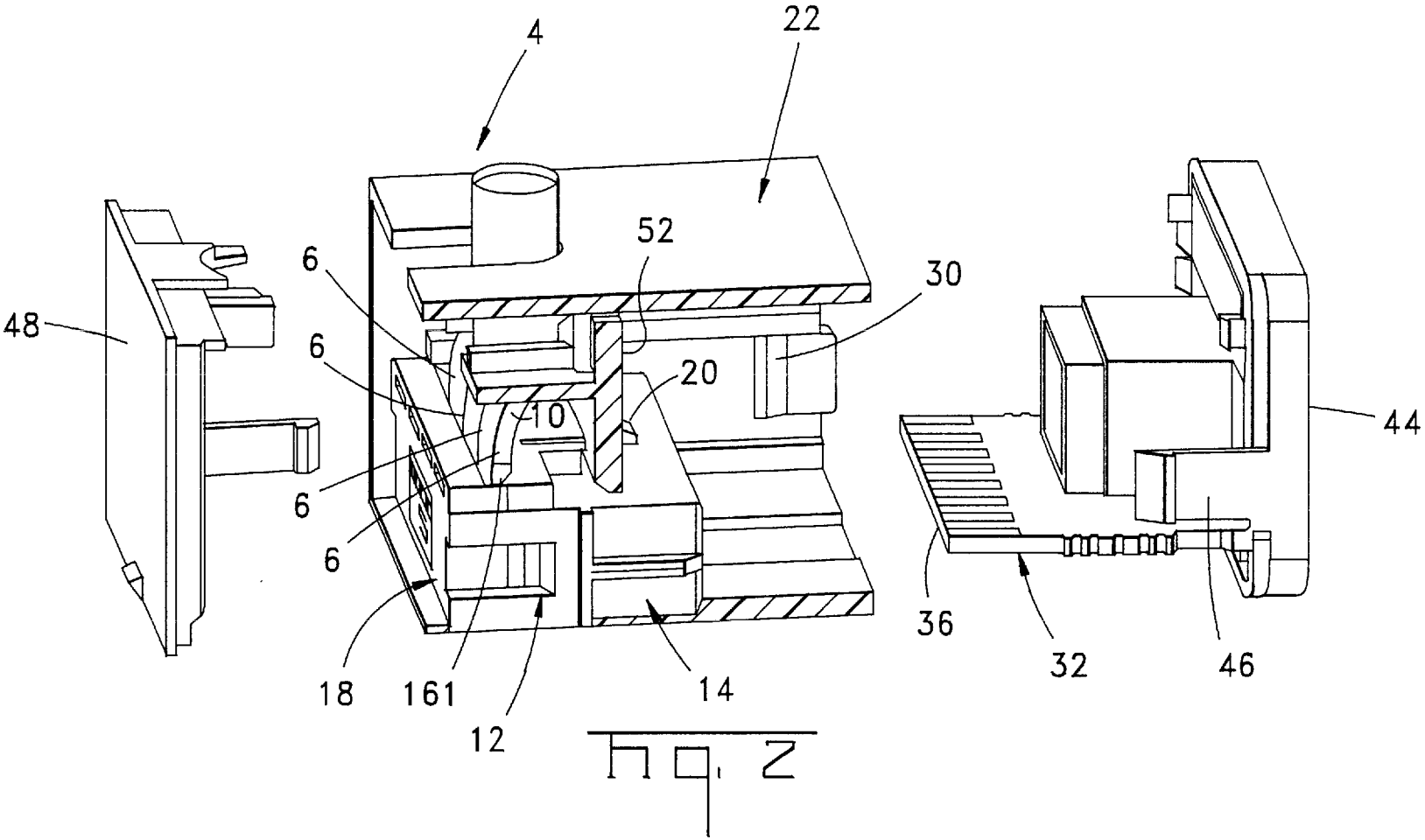
FIG. 2 is a partially assembled view of FIG. 1.

With reference now to FIG. 2, the electrical connector 12 according to the present invention is shown mounted within the box 22. The box 22 includes a mounting wall 52 which is engaged by the latch 20 for retaining the connector 12 therein. If the connector box 22 is conductive, either by having been formed from a conductive material or a metallized plastic, and the connector 12 is also advantageously formed of conductive material, such as metallized plastic, by placing the connector 12 within the box 22, the connector 12 will be electrically commoned thereto. This will have further advantageous effects.

With reference now to FIG. 3, the electrical connector 12 will now be described in greater detail. The electrical connector 12 incorporates a main housing 14. The main housing 14 has a mating side 54 which in this example includes the card receiving slot 16 (FIG. 1). It is important to note that while the present invention can be advantageously used in a card-edge connector style, that the invention should not be limited. The main housing 14 also includes an open cable side 56 that is divided into a plurality of compartments 58 by partitions 60. Advantageously, the main housing 14 will be formed from a conductive material or metallized plastic.

A plurality of contact carrying modules 62 are constructed to be received within compartments 58. The contact carrying modules 62 include opposing latches 64 so that they can be snapped in place within the main housing 14. The contact carrying module 62 is advantageously formed of insulative material although selective metallization could be used if desired. Each contact carrying module 62 includes two contacts 66 that are best seen and described in FIGS. 4 and 5. These contacts 66 include a mating end and a wire termination end 70.

The connector 12 further includes a rear cover 18 that is fittable to the main housing 14 by a pair of latch arms 72 designed to engage corresponding catches 74 upon the main housing 14. The cover 18 further includes multiple U-shaped cable tabs 76. It is also envisioned that tabs 76 may be omitted. The rear cover 18 will also be manufactured from a conductive material or advantageously a metallized plastic.

Figure 4:
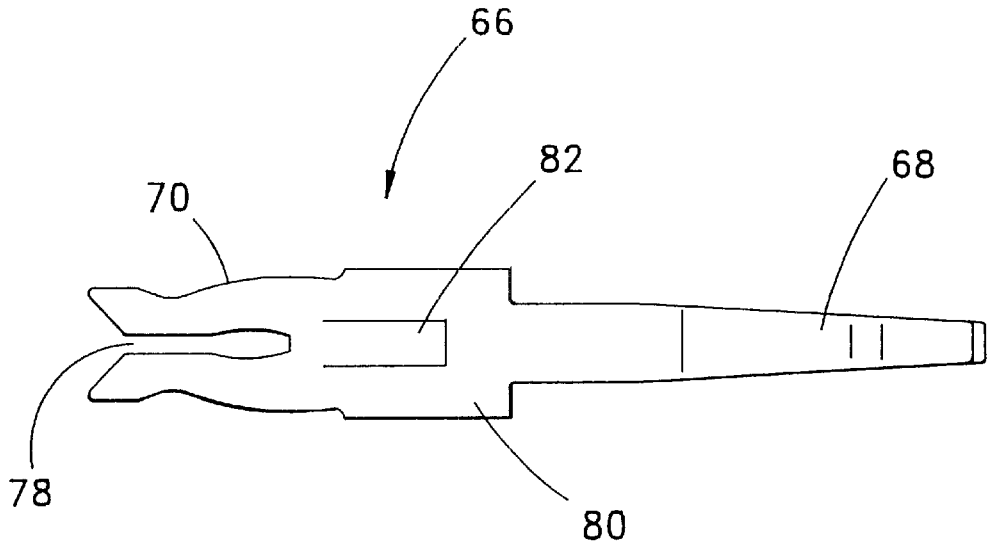
FIG. 4 is a top view of a contact of the connector of FIG. 3.
Figure 5:
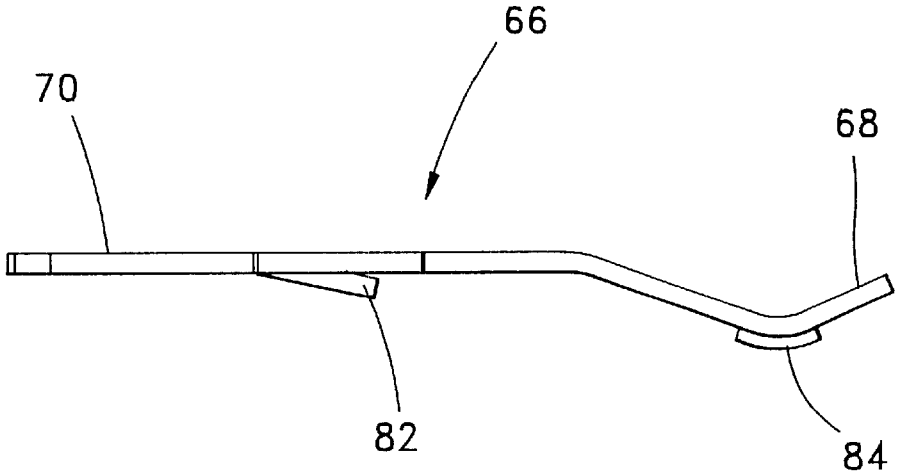
FIG. 5 is a side view of the contact of FIG. 4.

With reference now to FIGS. 4 and 5, the contact 66 will be described in greater detail. The contact 66 includes a mating end 68 that, in this embodiment, is a resilient tongue for engaging the conductive pads 38 of the card edge 36. Various configurations of this mating end 68 may be realized depending on the interface desired. The contact 66 further includes a cable termination end 70 that is formed as an insulation displacement contact (IDC). The IDC includes a wire receiving slot 78 for receiving an insulated wire and making connection thereto, as is well known in the industry. The wire termination end 70 could take on various other configurations, such as a crimp connection or a solder termination. A body section 80 is located between the mating end 68 and the wire termination end 70. The body portion 80 includes a retention lance 82 for incorporating the contact 66 into the contact carrying module 62. Various materials may be used for the contact 66 as desired and it may be advantageous to include a precious metal contact patch 84 for engaging the conductive pads 38 of the card edge 36.

Figure 6:
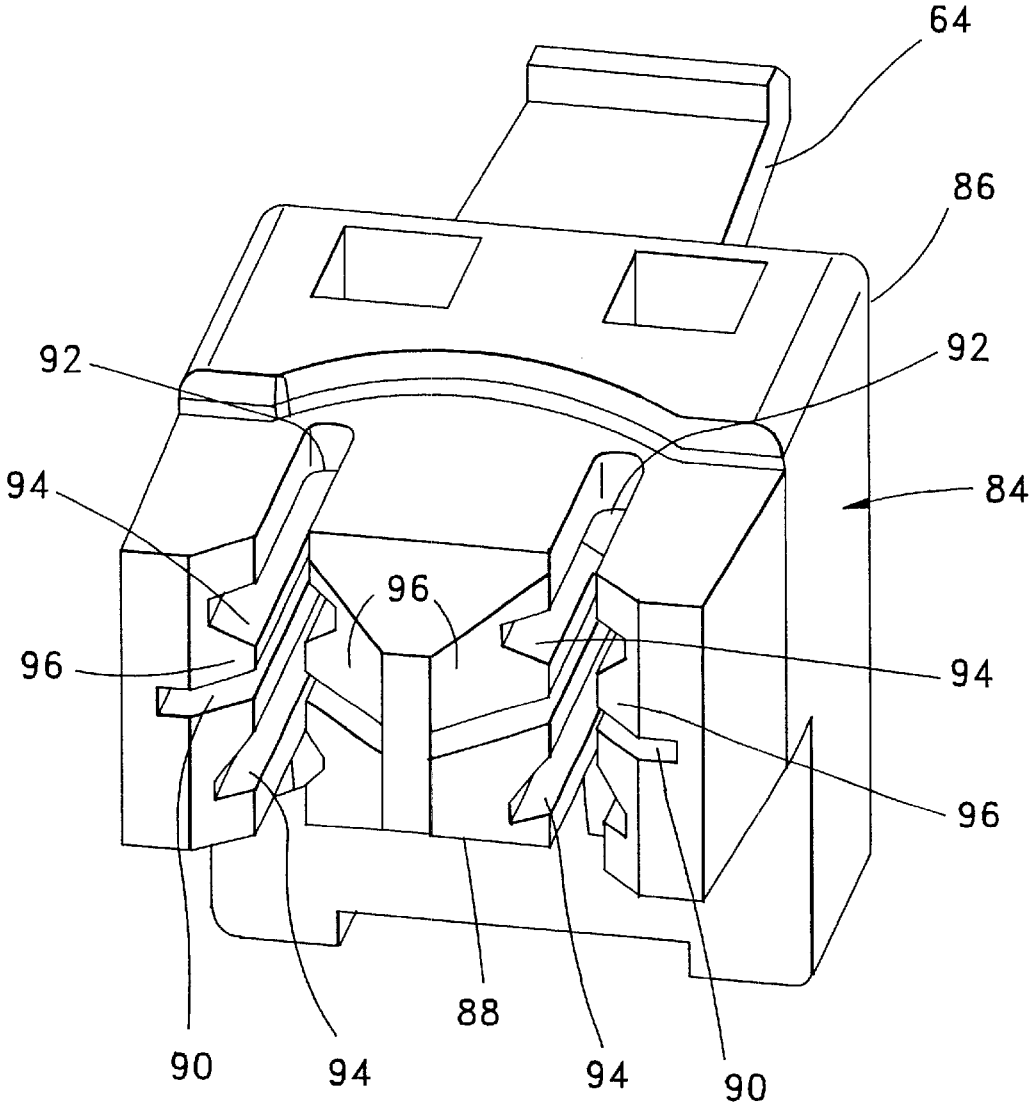
FIG. 6 is a rear perspective view of the contact carrying module used in the connector of FIG. 3.
Figure 7:
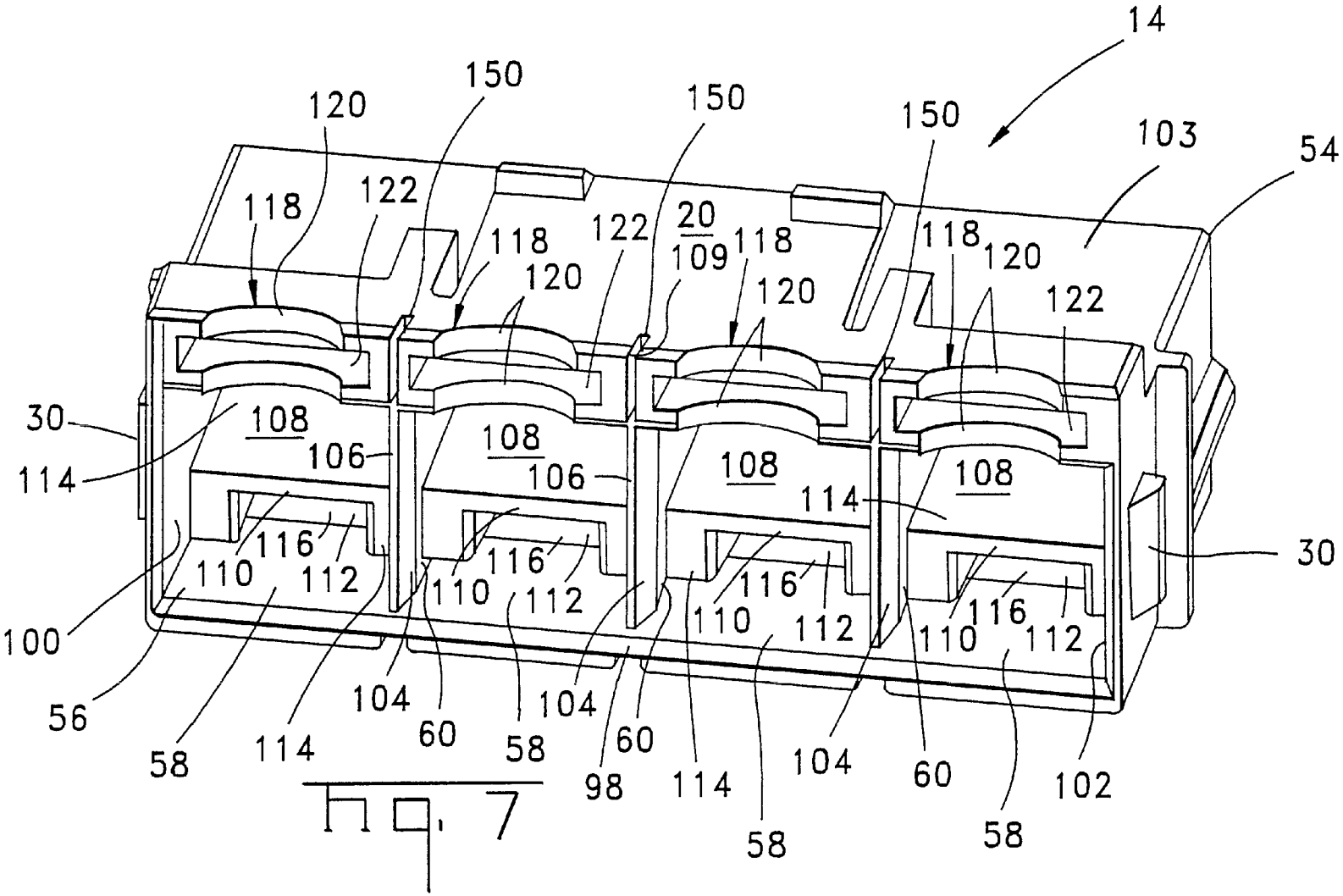
Figure 7:
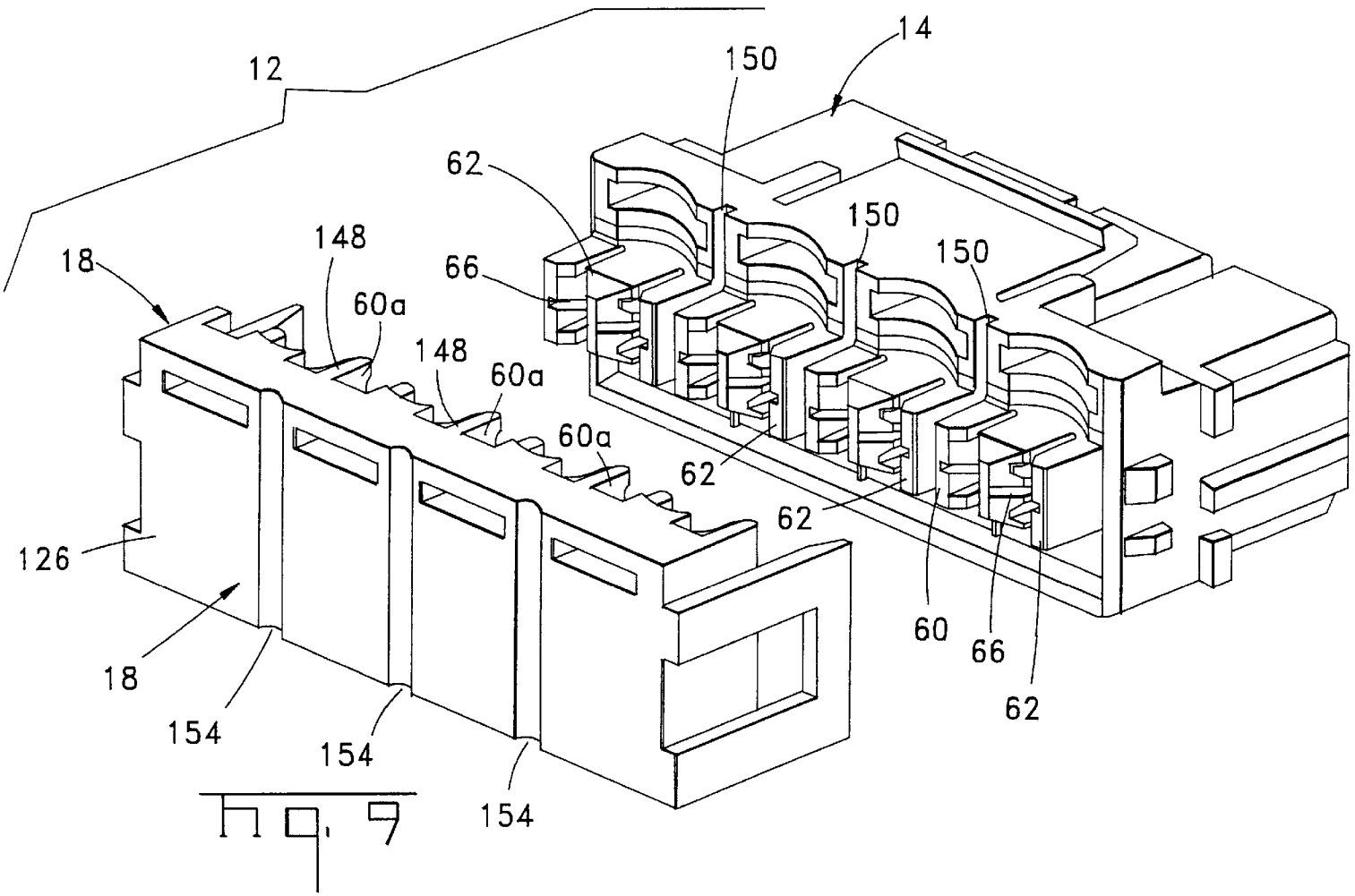

With reference now to FIG. 6, a body 84 that substantially makes up the contact carrying module 66 will be described in detail. The body 84 carries the two latches 64 extending from a front surface 86 thereof. The latches 64 retain a contact carrying module 62 within the main housing 14 in a manner best seen in FIG. 10. The body 84 includes a rear IDC portion 88 having a pair of contact passageways 90 that extend through the body 84 and open at the front surface 86 so that a contact 66 may be disposed therein (best seen in FIG. 10). A wire receiving slot 92 extends across the IDC termination portion 88 and the associated contact passageways 90 and is constructed for receiving the individual wires 8 of the twisted-pair conductors 6 therein. Additionally, on either side of the contact carrying passageway 90 are guide slots 94 that extend into the module 84 basically parallel to the contact receiving passageways 90. These guide slots 94, along with large chamfers 96 on both sides of the wire receiving slots 92, are useful for stabilizing a wire termination tool (not shown) that would be used to stuff the insulated wires into the IDC contact slot 70 of the contact 66 in a manner well known in industry.

Figure 7:
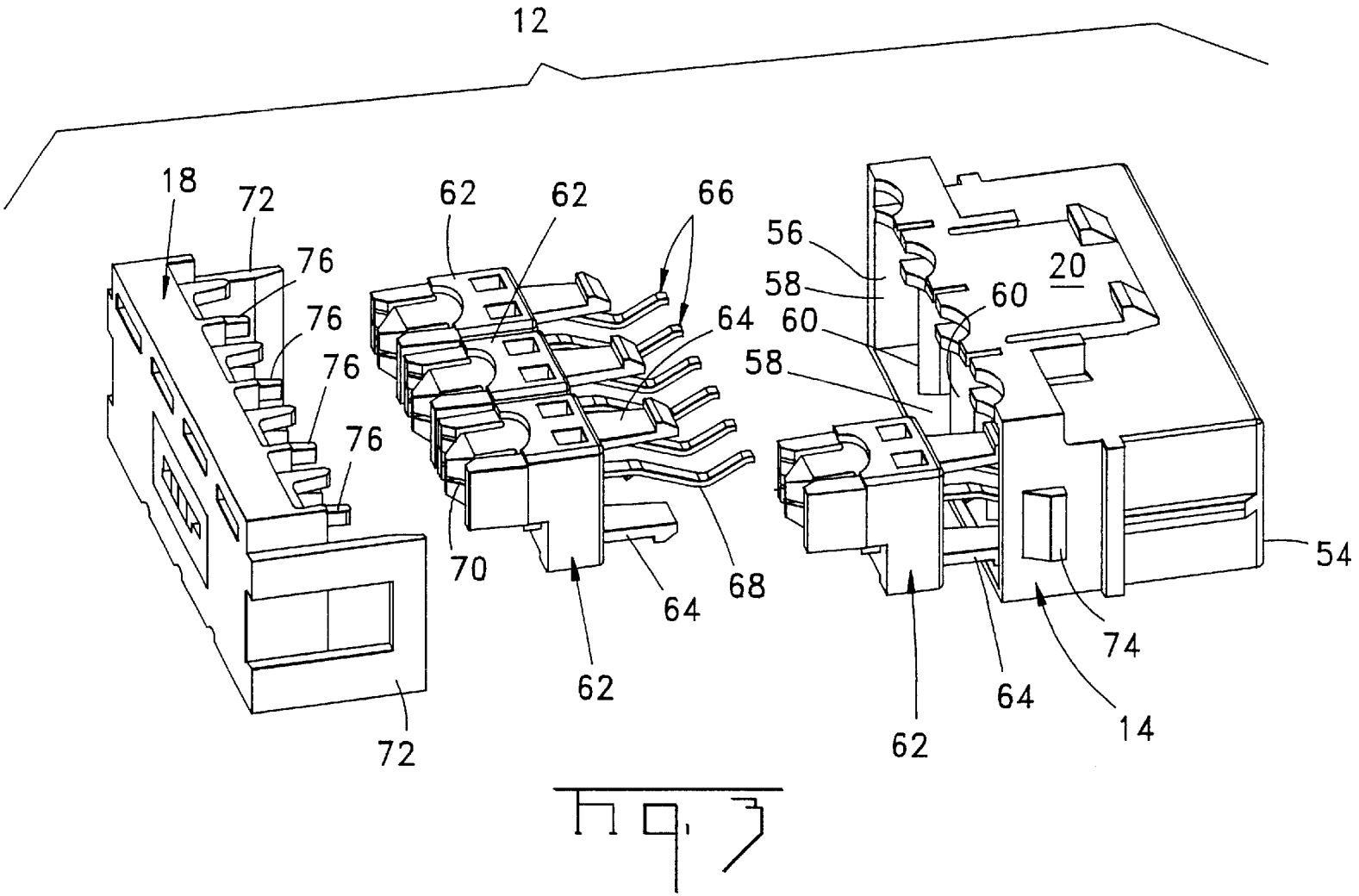
FIG. 7 is a rear perspective view of a main housing of the connector of FIG. 3.

With reference now to FIG. 7, the main housing 14 will be described in greater detail. The open cable side 56 of the main housing 14 is shell-like and defined by a lower wall 98, opposing side walls 100, 102 and upper wall 103. This shell-like open cable side 56 is further divided into a row of compartments 58 by partitions 60 that extend between the lower wall 98 and the upper wall 103. Advantageously, in this embodiment, the partitions 60 are formed as tongues having a chamfered surface 104 extending on a side thereof to an end 106 of the tongue 60. The end 106 of tongue 60 is slightly recessed from the open cable side 56 of the connector 14.

Each compartment 58 further includes a table 108 having an inverted, U-shaped, end 110 defining a passageway 112 thereunder and a passageway 114 thereover. The passageway 114 extends through the housing 14 to the mating side 54 while the passageway 112 exposes a latch 116 for retaining the contact carrying module 62. The table 108 is used to position the contact module 62 within the main housing 14.

The upper wall 103 is considerably thicker than the lower wall 98 or the side walls 100, 102 in this embodiment. The reason for this is that the upper wall 103 carries at least a first portion of a wire exit saddle 118. The first portion of this wire exit saddle 118 includes a pair of scalloped saddle surfaces 120 that are separated by a tab receiving trough 122 that extends into the wall 103 for receiving the U-shaped tabs 76 of the cover 18, as will be described below. As mentioned above, the main housing 14 would either be manufactured from a conductive material or molded from plastic and metallized such that the main housing 14 would provide shielding or anything received therein.

With reference now to FIG. 8, the end cover 18 that is constructed to close the open cable side 56 of the main housing 14 will be described in greater detail. The end cover 18 includes latches 72 to engage the catches 30 of the main housing in order to fix the cover 18 to the main housing 14. The cover 18 includes a body portion 124 having a rearward side 126 and a connector side 128. An interior surface 130 of the rearward side 126 faces the connector side 128. Combined with side walls 132, 134, lower wall 136 and upper wall 140, a trough-like structure is formed. The trough-like structure is further divided into compartments 58A by second partitions 60A that correspond to the partitions 60 of the main housing 14, as will be described below with reference to FIGS. 11 and 12. The second partition 60A also include chamfers 104A that extend along sides of the partition 60A to ends 142. It is important to note that at least a portion of the chamfer 104A of the partition 60A extends beyond the connector surface 128 in order to provide the ends 142 of the partition 60 with some flexibility. In this particular embodiment, the second partition 60A itself extends a small distance 144 beyond the connector edge 128. Further, the end 142 of the partitions extends upwards to a ledge 146 such that the second partitions 60A would be received between the lower wall 98 and the upper wall 103 of the main housing 14 when the cover 18 is fitted thereto. Advantageously, the cover 18 would be manufactured from a conductive material or a metallized plastic mold. A portion 148 of the partition 60A extends above the ledge 146 to be received within slots 150 formed in the upper wall 103 of the main housing 14 that correspond to the partition 60 therein. In addition, located along the upper wall 140 of the cover 18 are a plurality of U-shaped tabs 76 constructed to be received within the troughs 122 of the main housing 14. These legs of the U-shaped tabs 76 may take on various lengths as desired and provide some strain relief for the twisted-pair wire 6 and discontinuity in any pathway. As mentioned above, these tabs 76 are optional. At the base of the U-shaped tab 76 is a second saddle portion 152 that will be disposed opposite the first saddle portion 118 in the main housing 14.

With reference now to FIG. 9, the electrical connector 12 is shown in partially assembled form. The contact carrying modules 62, with the contacts 66 therein, are shown received within the main housing 14. The cover 18 is positioned to be mounted upon the main housing 14. As can be seen, the partition 60A will be received between adjacent contact carrying modules 62 and the upper portions 148 of the partition 60A will be received in the slots 150. Additionally, if desired to improve the flexibility of the cover 18, reliefs 154 may be provided in the rear surface 126.

With reference now to FIG. 10, the electrical connector 12 is shown in assembled form. The contact carrying module 62 with the contact 66 is fitted to the housing 14 by the latch members 64 engaging corresponding latches 116 formed in the main housing 14. The contact 66 extends through the contact carrying passageway 90 such that the mating end 68 is disposed in the card edge receiving slot 16 on the mating end 54 of the main housing 14. The contact 66 is retained therein by the locking lance 82 that is received in a recess 156 of the body 84 in order to further retain the contact 66. A staking operation can be performed that utilizes the recess 158 above the contact lance 82 prior to assembling of the module 62 with the main housing 14 to further assure contact retention. At this point, the main housing has been assembled to the extent shown in FIG. 9.

With the cover 18 attached to the main housing 14 as shown in FIG. 10, the open cable side 56 of the main housing 14 has been closed. A wire exit 160 is defined by the two saddle portions 120, 152 of the main housing 14 and cover 18 respectively for each of the compartments 58. This wire exit 160 is configured to be slightly smaller than that of the wires exiting such that an interference will exist. This interference is advantageously taken advantage of by allowing the shielding 10 that surrounds the wires 8 to extend into the compartment and be terminated only slightly above the rear IDC portion 88 of the contact module 62 when the various conductors 6 are being terminated. Once the cover 18 is attached to the main housing 14, it is easily recognized that the saddle portions 120, 152 will come into engagement with the shielding 10. As both the main housing 14 and the cover 18 are manufactured from either conductive material or metallized plastic, the saddle surfaces 120, 152 are electrically commoned to the shielding 10.

Returning to FIG. 1 and FIG. 2, it can be seen that as a result of closing of the rear cover 18 upon the main housing 14 with the conductors 6 extending therefrom, the shielding 10 of the individual conductors is slightly compressed in the region 161 indicating engagement with the housing 14 and cover 18.

With reference now to FIGS. 11 and 12, in addition to providing for the commoning of the conductive main housing 14 and rear cover 18 to the shielding 10 of the individual conductors 6 by way of the saddle portions 120, 152, it is necessary to also assure that the termination and contacts within adjacent compartments 58 are completely isolated from one another. This is reliably achieved by the first partitions 60 of the main housing 14 and the second partition 60A of the cover 18 being provided with respective chamfers 104, 104A and configured such that the respective ends 106, 142 also overlap and result in a slight interference 162 within the space 164 between adjacent modules 84 contained within their respective compartments 58. As can be imagined, this space 164 and the associated partition walls are extremely thin and, hence, some flexibility of the partitions 60, 60A is realized. Furthermore, it is this space requirement that prevents easily manufacturing these partitions as a single piece extending outward from either the cover 18 or the housing 14 exclusively. As each of the partitions 60, 60A are conductive, a shielding partition is formed between adjacent compartments 58.

Advantageously then, what is realized from the present invention is a structure that continues the shielding 10 provided to the twisted pair of wires 8 to a compartment 58 within a connector 12 such that a fully shielded twisted-pair interconnection is provided, thereby greatly reducing the effect of cross-talk from adjacent signal conductors 6 and any spurious electromagnetic fields.

We claim:

1. A high frequency connector; comprising:

a main housing having an open mounting side, a cable side and a first partition at the cable side defining two compartments where each compartment is in communication with the mounting side and the cable side;

a plurality of contacts, where a pair of contacts are positioned in the compartments such that the contacts are exposed for mating with a complementary electrical interface on the mating side and with wires of a cable on the cable side; and a rear cover that is fittable to the main housing on the cable side in order to close the open cable side and cover the exposed contacts therein where the cover further includes a second partition configured to mechanically and electrically engage the first partition of the main housing, wherein the two partitions are conductive and act as a shield between the two compartments.

2. The high frequency connector of claim 1, wherein the connector includes a conductive saddle for electrically engaging a conductive shield about the wires of the cable.

3. The high frequency connector of claim 2, wherein the connector includes conductive saddles at each compartment.

4. The high frequency connector of claim 3, wherein the saddle portion is formed on each of the main housing and the rear cover to capture the conductive shield therebetween.

5. The high frequency connector of claim 1, wherein one of the first partition or second partition includes a tapered section to engage the other.

6. The high frequency connector of claim 5, wherein both partitions include complementary tapered sections.

* * * * *